US009091039B2

(12) United States Patent
Dobchuk et al.

(10) Patent No.: US 9,091,039 B2
(45) Date of Patent: Jul. 28, 2015

(54) RIDE CONTROL SYSTEM

(75) Inventors: Jeffery W. Dobchuk, Saskatoon (CA); Joshua D. Graeve, Peosta, IA (US); Brian K. Kellogg, Bellevue, IA (US); Derek S. Hall, Dubuque, IA (US); Eric R. Anderson, Galena, IL (US)

(73) Assignee: Deere & Company, Moline, IL (US)

( * ) Notice: Subject to any disclaimer, the term of this patent is extended or adjusted under 35 U.S.C. 154(b) by 700 days.

(21) Appl. No.: 13/410,993

(22) Filed: Mar. 2, 2012

(65) Prior Publication Data

US 2013/0227937 A1 Sep. 5, 2013

(51) Int. Cl.

| | |
|---|---|
| ***F15B 1/027*** | (2006.01) |
| ***E02F 9/22*** | (2006.01) |
| ***F15B 1/02*** | (2006.01) |

(52) U.S. Cl.

CPC ..... *E02F 9/2207* (2013.01); *E02F 9/2217* (2013.01); *F15B 1/021* (2013.01); *F15B 1/027* (2013.01)

(58) Field of Classification Search

CPC ..... E02F 9/2207; E02F 9/2217; E02F 9/226; F15B 21/008; F15B 1/021; F15B 1/027; F15B 2211/8616

USPC ..... 60/413, 416, 418, 469, 327

See application file for complete search history.

(56) References Cited

U.S. PATENT DOCUMENTS

| | | | | |
|---|---|---|---|---|
| 5,706,657 | A * | 1/1998 | Amborski et al. | 60/413 |
| 6,167,701 | B1 * | 1/2001 | Hatcher et al. | 60/416 |
| 7,194,856 | B2 * | 3/2007 | Ma et al. | 60/418 |

* cited by examiner

*Primary Examiner* — Dwayne J White
*Assistant Examiner* — Logan Kraft
(74) *Attorney, Agent, or Firm* — Taft Stettinius & Hollister LLP; Stephen F. Rost

(57) ABSTRACT

A ride control system and method where the system includes first hydraulics for equalizing pressure between ride control accumulators and boom cylinder head side, and second hydraulics for providing low pressure drop connection between ride control accumulators and boom cylinder head side. When ride control is engaged, the first hydraulics equalizes pressure between ride control accumulators and boom cylinder head side to within a pressure threshold, then the second hydraulics provides the low pressure drop connection between ride control accumulators and boom cylinder head side. Ride control system can include third hydraulics for providing fluid connection between boom cylinder rod side and tank; where after first hydraulics equalizes pressure to within pressure threshold, then third hydraulics provides connection between boom cylinder rod side and tank. The ride control system can also monitor the condition of the ride control accumulators.

20 Claims, 3 Drawing Sheets

RIDE CONTROL SYSTEM

FIELD OF THE INVENTION

The present invention generally relates to the field of hydraulic vehicle control and more specifically to activation and control of a ride control system.

BACKGROUND OF THE INVENTION

Some machines have a ride control system that is hydraulically coupled with other hydraulic systems, for example a loader or boom system. In these and similar machines, it is desirable to have pressure equalization between the ride control system and the coupled hydraulic systems prior to ride control activation. By matching the pressure between the ride control accumulators and the pressure in, for example, the boom cylinders any unintended raising or lowering motion in the boom can be avoided or reduced when ride control is engaged.

It would be desirable to have the ride control system designed to perform one or more of the following functions: (1) to equalize the pressure between the head side of the loader cylinder and the ride control cylinders, (2) to provide a low pressure drop connection between the head side of the loader boom cylinder and the cushioning volume in the ride control accumulators, and (3) to provide a low pressure drop connection between the rod side of the loader boom cylinder and tank. It would also be desirable to have the ride control system perform some auxiliary functions, which could include: (1) to provide a mechanism for dead engine lower, (2) to provide a mechanism for safely discharging the pressure in the ride control accumulators, and (3) to provide condition monitoring of the ride control accumulators.

SUMMARY

A ride control system is disclosed for a machine having a main hydraulic system, a ride control accumulator, a tank, and a boom cylinder, where the boom cylinder has a head side and a rod side. The ride control system includes a first hydraulic system for equalizing pressure between the ride control accumulator and the head side of the boom cylinder, and a second hydraulic system for providing a low pressure drop connection between the ride control accumulator and the head side of the boom cylinder. When the ride control system is engaged, first the first hydraulic system equalizes pressure between the ride control accumulator and the head side of the boom cylinder to within a pressure difference threshold, and then the second hydraulic system provides the low pressure drop connection between the ride control accumulator and the head side of the boom cylinder. The ride control system can also include a third hydraulic system for providing a hydraulic connection between the rod side of the boom cylinder and the tank; where after the first hydraulic system equalizes pressure between the ride control accumulator and the head side of the boom cylinder to within the pressure difference threshold, then the third hydraulic system provides the hydraulic connection between the rod side of the boom cylinder and the tank. The ride control system can also include an accumulator pressure sensor that monitors the pressure of the ride control accumulator, where readings from the accumulator pressure sensor are used for equalizing pressure between the ride control accumulator and the head side of the boom cylinder.

The first hydraulic system can include a ride control valve providing fluid connection between the main hydraulic system and the ride control system, and a fourth control valve providing fluid connection between the ride control system and the tank. The ride control system can also include a check valve that prevents fluid flow from the ride control system to the main hydraulic system. The first hydraulic system can also include a tank valve in pressure balance between the pressure in the ride control accumulator and the pressure in the head side of the boom cylinder. When the pressure in the ride control accumulator is greater than the pressure in the head side of the boom cylinder, the tank valve vents pressure from the ride control accumulator to the tank, and when the pressure in the ride control accumulator is less than the pressure in the head side of the boom cylinder, the tank valve prevents the release of pressure from the ride control accumulator to the tank.

The second hydraulic system can include a logic valve for providing a fluid connection between the ride control accumulator and the head side of the boom cylinder, the logic valve including an internal pilot and an external pilot, a first control valve for providing a fluid connection between the ride control system and the external pilot of the logic valve, and a second control valve for providing fluid connection between the external pilot of the logic valve and the tank. Activating the first control valve blocks hydraulic flow from the ride control system to the external pilot of the logic valve, activating the second control valve vents the external pilot of the logic valve to the tank, and activating both the first and second control valves simultaneously vents the external pilot of the logic valve to the tank and enables the logic valve to open and close through the internal pilot.

A method is disclosed for controlling a ride control system of a machine having a main hydraulic system, a ride control accumulator, a tank, and a boom cylinder, the boom cylinder having a head side and a rod side. The method includes waiting until a ride control selector of the machine is enabled and boom controls of the machine are idle; equalizing pressures of the ride control accumulator and the head side of the boom cylinder; after equalizing pressures of the ride control accumulator and the head side of the boom cylinder, providing a low pressure drop connection between the ride control accumulator and the head side of the boom cylinder; and disabling ride control when the ride control selector is disabled. Ride control can also be disabled if the boom controls are activated. The method can also include, after equalizing pressures of the ride control accumulator and the head side of the boom cylinder, providing a hydraulic connection between the rod side of the boom cylinder and the tank.

The method can also include determining whether automatic or manual ride control mode is selected; and disabling ride control when ride control mode is switched from automatic mode to manual mode, or from manual mode to automatic mode. The method in automatic ride control mode can also include, after equalizing pressures of the ride control accumulator and the head side of the boom cylinder, determining if machine speed is greater than a speed threshold; waiting until machine speed is greater than the speed threshold before providing the low pressure drop connection between the ride control accumulator and the head side of the boom cylinder, and before providing the hydraulic connection between the rod side of the boom cylinder and the tank; and disabling ride control when machine speed goes below the speed threshold after machine speed was above the speed threshold.

Equalizing pressures of the ride control accumulator and the head side of the boom cylinder can include determining the pressure difference between the ride control accumulator and the head side of the boom cylinder; comparing the determined pressure difference to a threshold pressure difference;

and when the determined pressure difference is greater than the threshold pressure difference, adjusting the pressure of the ride control accumulator to make the determined pressure difference less than the threshold pressure difference. Adjusting the pressure of the ride control accumulator can include, when the pressure of the ride control accumulator is less than the pressure of the head side of the boom cylinder, using the main hydraulic system to increase pressure in the ride control accumulator; and when the pressure of the ride control accumulator is greater than the pressure of the head side of the boom cylinder, venting excess fluid from the ride control accumulator to the tank. Decreasing the pressure of the ride control accumulator can include using a tank valve to pressure balance between the ride control accumulator pressure and the head side boom cylinder pressure, such that when the pressure in the ride control accumulator is greater than the pressure in the head side of the boom cylinder, fluid is vented from the ride control accumulator through the tank valve to the tank, and when the pressure in the ride control accumulator is not greater than the pressure in the head side of the boom cylinder, fluid is blocked from venting from the ride control accumulator through the tank valve to the tank.

Providing a low pressure drop connection between the ride control accumulator and the head side of the boom cylinder can include enabling a logic valve to open through an internal pilot of the logic valve. Providing a low pressure drop connection between the ride control accumulator and the head side of the boom cylinder can also include blocking fluid connection between the ride control system and an external pilot of the logic valve; and providing fluid connection between the external pilot of the logic valve and the tank.

The method can also include monitoring the condition of the ride control accumulator. Monitoring the condition of the ride control accumulator can include increasing the pressure of the ride control accumulator to a high threshold pressure; discharging the fluid of the ride control accumulator over a known hydraulic restriction; recording a decay time it takes for the ride control accumulator pressure to go from the high threshold pressure to a low threshold pressure, the low threshold pressure being less than the high threshold pressure; and using the decay time to determine the condition of the ride control accumulator.

DETAILED DESCRIPTION

Figure 1:
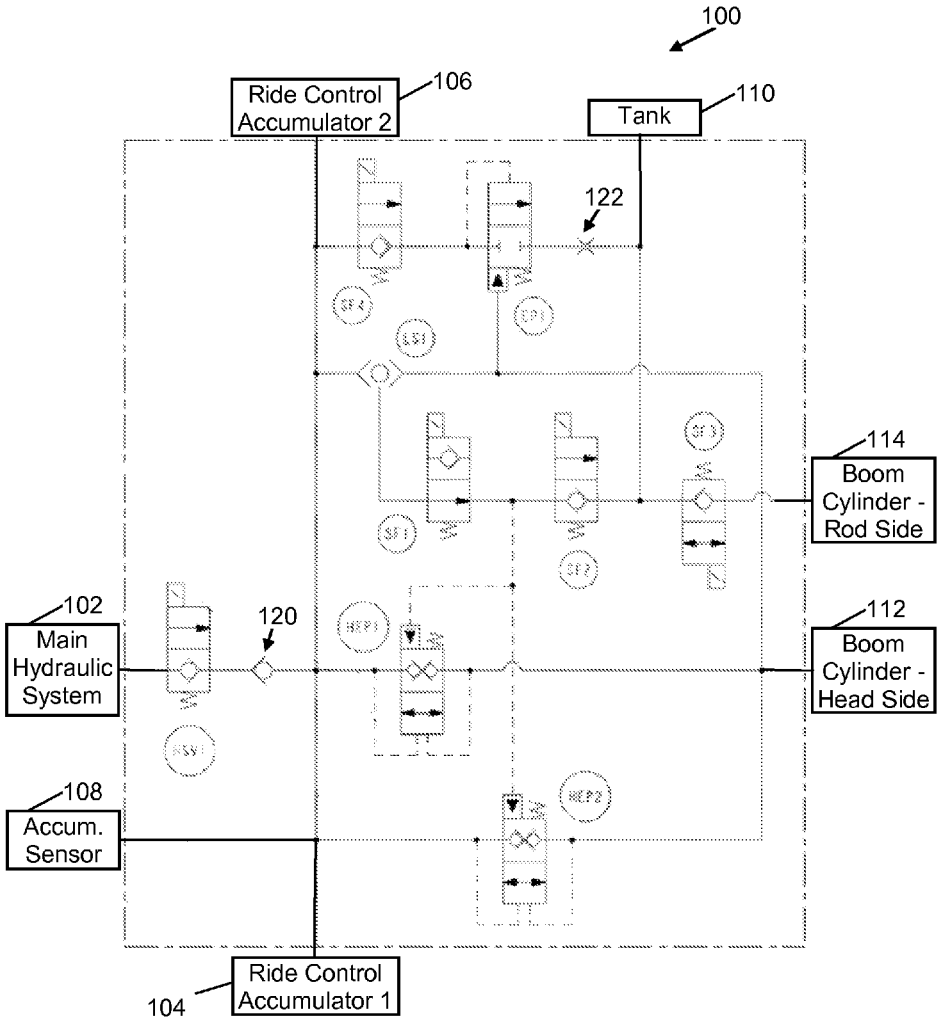
FIG. 1 shows a schematic diagram of the hydraulics for an exemplary embodiment of a ride control system.

For the purposes of promoting an understanding of the principles of the novel invention, reference will now be made to the embodiments described herein and illustrated in the drawings and specific language will be used to describe the same. It will nevertheless be understood that no limitation of the scope of the novel invention is thereby intended, such alterations and further modifications in the illustrated devices and methods, and such further applications of the principles of the novel invention as illustrated therein being contemplated as would normally occur to one skilled in the art to which the novel invention relates.

The ride control system can perform one or more of the following functions: (1) equalize the pressure between the head side of the boom cylinder and the ride control cylinders, (2) provide a low pressure drop connection between the head side of the boom cylinder and the cushioning volume in the ride control accumulators, and (3) provide a low pressure drop connection between the rod side of the boom cylinder and tank. The ride control system can also be designed to perform auxiliary functions, including for example: (1) to provide a mechanism for dead engine lower, (2) to provide a mechanism for safely discharging the pressure in the ride control accumulators, and (3) to provide condition monitoring of the ride control accumulators.

FIG. 1 shows a schematic diagram of the hydraulics for an exemplary embodiment of a ride control system 100 that includes a ride control valve HSV1, a tank valve EP1, four control valves SF1-SF4, two logic valves HEP1 and HEP2, a check valve 120 and an orifice 122. The ride control system 100 is hydraulically coupled to a main hydraulic system 102, ride control accumulators 104, 106, a ride control accumulator pressure sensor 108, tank 110, the head side of a boom cylinder 112 and the rod side of the boom cylinder 114.

The ride control valve HSV1 provides a fluid connection between the ride control system 100 and the main hydraulic system 102. In an electronic pump control system, it may be necessary to stroke the pump of the main hydraulic system 102 to ensure oil is supplied through the ride control valve HSV1 to the ride control accumulators 104, 106. The check valve 120 can be used to prevent backflow from the ride control system 100 to the main hydraulic system 102. The amount of flow can be determined by field testing. In a load sense controlled system, the accumulator pressure sensor 108 can be used to monitor the pressure to the ride control accumulators 104, 106 in order to control pump flow. By activating ride control valve HSV1 and activating the main hydraulic system 102, the pressure in the ride control accumulators 104, 106 can be increased.

The fourth control valve SF4 provides a fluid connection to the tank 110 via the tank valve EP1 and the orifice 122. The head side of the boom cylinder 112 and the rod side of the boom cylinder 114 are also fluidly connected to the ride control system 100. When the fourth control valve SF4 is active, the tank valve EP1 is in a pressure balance between the accumulator pressure and the boom cylinder head pressure. As shown in FIG. 1, when the valve SF4 is active, the accumulator pressure exerts pressure on one side of the tank valve EP 1 and the boom cylinder head pressure exerts pressure on the opposite side of the tank valve EP1. The tank valve EP1 is forced open when the accumulator pressure is greater than the boom cylinder head pressure by an amount sufficient to overcome the spring bias of the valve EP1 (which is typically small). By activating the fourth control valve SF4, the pressure in the ride control accumulators 104, 106 can be reduced.

Activating the first control valve SF1, blocks the supply passage of external pilot oil to the logic valves HEP1 and HEP2. Activating the second control valve SF2, vents the supply passage of external pilot oil to tank 110. Simultaneous activation of the first and second control valves SF1, SF2 reduces the external pilot pressure to tank and allows the logic valves HEP1, HEP2 to open through their internal pilot. This opens a low pressure drop passage between the boom cylinder head side 112 and the ride control accumulators 104, 106. A sufficiently large direct acting valve could be used to alleviate the need for the valves to be piloted.

Activating the third control valve SF3 connects the boom cylinder rod side 114 to tank 110.

Figure 2:
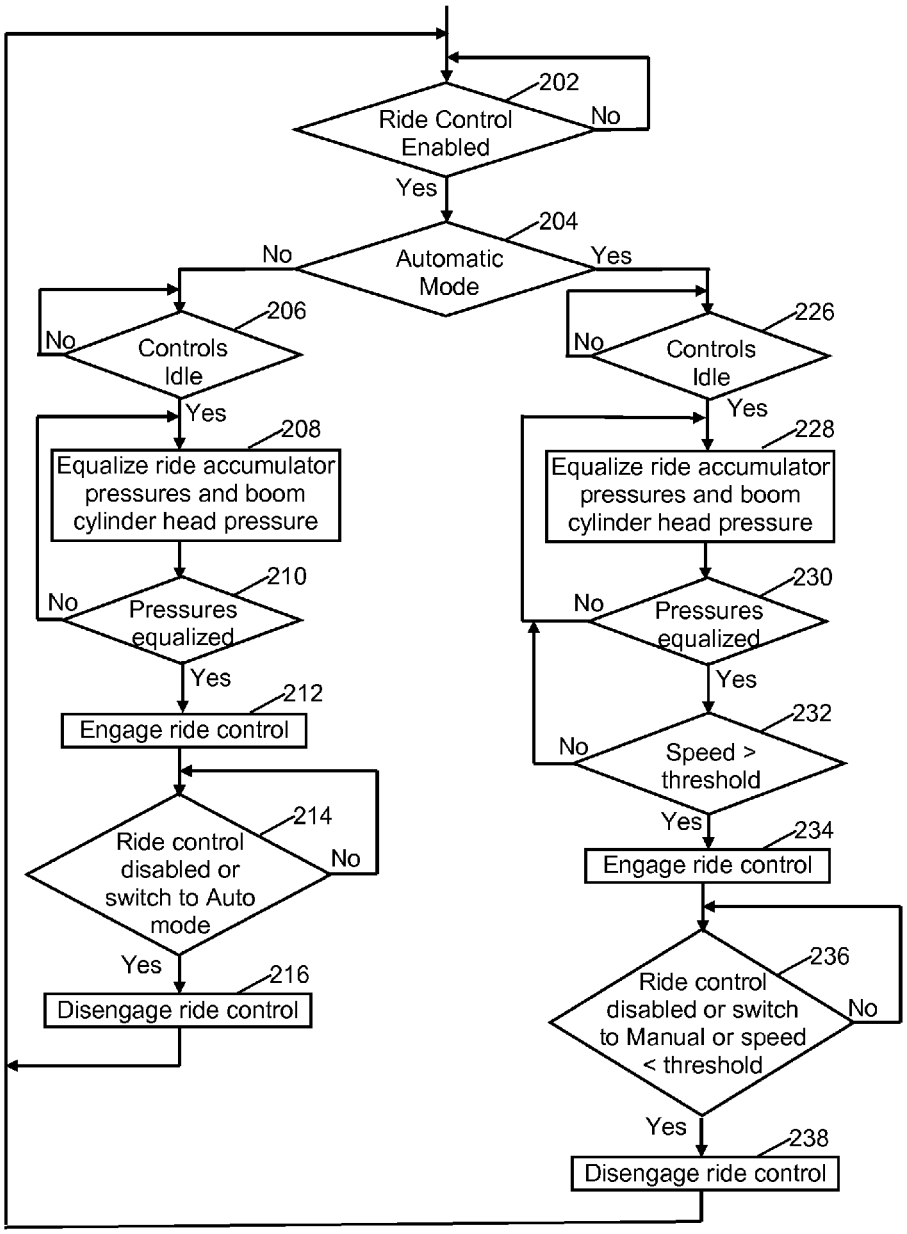
FIG. 2 shows an exemplary control method for a ride control system.

FIG. 2 is an exemplary flow chart for a ride control system. At block 202 the system waits until ride control is enabled by the operator. When ride control is enabled control passes to block 204 to determine if automatic or manual mode is selected. If automatic mode is selected control passes to block 226, otherwise control passes to block 206 for manual mode.

In manual mode, at block 206 the system checks whether the boom controls are idle. The system waits at block 206 until the boom controls are idle. When the boom controls are idle, control passes to block 208.

At block 208, the system equalizes the pressures in the ride control accumulators 104, 106 with the pressure in the boom cylinder head side 112. Pressure equalization happens prior to ride control activation to match the pressure in the ride control accumulators 104, 106 with the head pressure in the boom cylinders 112 so that there is no unintended raise or lower motion in the boom when ride control is engaged. During equalization the valves HSV1 and SF4 are activated. At block 210, the system checks if the pressures are equalized. If the pressures are not sufficiently equalized, control remains with the pressure equalization routine of block 208. When the pressures are sufficiently equalized control passes to block 212.

The following steps provide an exemplary pressure equalization routine. First, the system can test whether pressure equalization is complete by comparing the difference between the ride accumulator pressure and the boom cylinder head pressure with a threshold pressure difference. If the pressure difference exceeds the threshold, then the system can determine if the ride control accumulator pressure needs be raised or lowered. If the ride control accumulator pressure needs to be raised, then valves HSV1 and SF4 can be activated and the pump of the main hydraulic system 102 can be stroked until the pressure of the ride control accumulators 104, 106 and the pressure of the boom cylinder head side 112 agree within some tunable accuracy. If the ride control accumulator pressure needs to be lowered, then valves HSV1 and SF4 can be activated to vent the pressure of the ride control accumulators 104, 106 to the tank 110 until the pressure of the ride control accumulators 104, 106 and the pressure of the boom cylinder head side 112 agree within some tunable accuracy. When sufficient pressure agreement is reached or if the boom controls become active or if the ride control status becomes inactive, the valves HSV1 and SF4 are closed and the pump of the main hydraulic system 102 can be destroked if necessary. In another system, a load sensing system for example, this could be done by closing a communication valve between the accumulator pressure and the pump.

At block 212, after pressure equalization is complete then ride control is engaged. When ride control is engaged valves SF1, SF2 and SF3 are activated. Activating valves SF1 and SF2 opens the low pressure drop passage between the boom cylinder head side 112 and the ride control accumulators 104, 106. Activating valve SF3 connects the boom cylinder rod side 114 to the tank 110. At block 214, the system checks for various triggering events to disengage manual ride control, including for example: (a) if ride control is disabled by the operator, or (b) if ride control is switched to automatic mode. Ride control can also be disabled if the boom controls are activated. The system remains at block 214 with manual ride control engaged until one of the triggering events occurs. When one of the triggering events occurs, control passes to block 216 where ride control is disengaged and valves SF1, SF2 and SF3 are deactivated; then control passes back to block 202.

The control flow for automatic mode is very similar to the flow for manual control, but they are explained separately for clarity. In automatic mode, at block 226 the system checks that the boom controls are idle. The system waits at block 226 until the boom controls are idle. When the boom controls are idle, control passes to block 228.

At block 228, the system equalizes the pressures in the ride control accumulators 104, 106 with the pressure in the boom cylinder head side 112. Pressure equalization happens prior to ride control activation to match the pressure in the ride control accumulators 104, 106 with the head pressure in the boom cylinders 112 so that there is no unintended raise or lower motion in the boom when ride control is engaged. During equalization the valves HSV1 and SF4 can be activated in the equalization routine described above. At block 230, the system checks if the pressures are equalized. If the pressures are not sufficiently equalized, control remains with the pressure equalization routine of block 228. When the pressures are sufficiently equalized control passes to block 232.

At block 232, the system checks if the vehicle speed is greater than a speed threshold. If the vehicle speed is not greater than the speed threshold, the control returns to block 228, otherwise control passes to block 234.

At block 234, after pressure equalization is complete and the speed exceeds the speed threshold then ride control is engaged. At block 236, the system checks for various triggering events to disengage automatic ride control, including for example: (a) if ride control is disabled by the operator, or (b) if ride control is switched to manual mode, or (c) if vehicle speed goes below the speed threshold. Ride control can also be disabled if the boom controls are activated. The system remains at block 236 with automatic ride control engaged until one of the triggering events occurs. When one of the triggering events occurs, control passes to block 238 where ride control is disengaged and valves SF1, SF2 and SF3 are deactivated; then control passes back to block 202.

The ride control valve can be used as a diagnostic tool for monitoring the precharge condition of the gas in the ride control accumulators. The stored energy in the accumulator is related to the precharge pressure. This energy may be quantified by measuring how long the accumulator takes to discharge from a high pressure state to a low pressure state by flowing oil over a known hydraulic restriction. The restriction in the exemplary embodiment of FIG. 1 is the orifice 122. Through proper sequencing, the ride control accumulators 104, 106 can be forced to discharge over the orifice 122 and the condition of the ride control accumulators 104, 106 can be determined from the time it takes to move from a first pressure state to a second pressure state.

Figure 3:
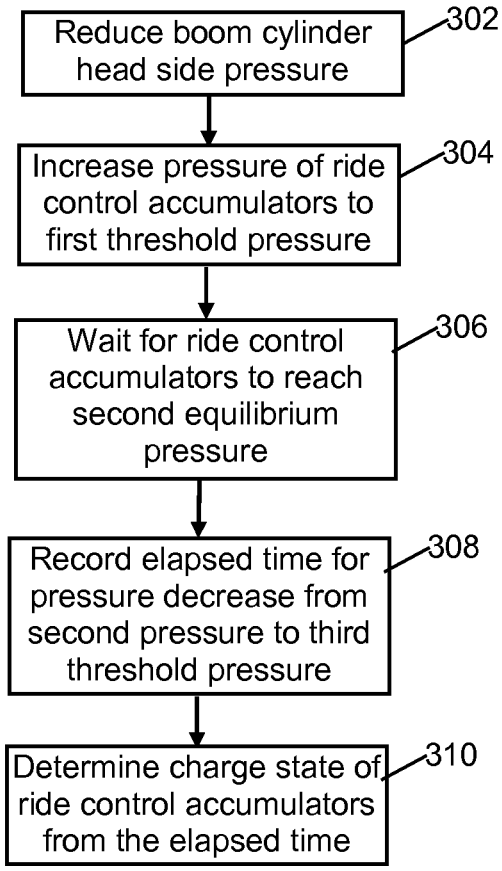
FIG. 3 shows an exemplary ride control accumulator condition monitoring procedure.

The ride control accumulator condition monitoring test can be performed using the exemplary control flow shown in FIG. 3. This description will refer to the elements of the exemplary embodiment of a ride control system shown in FIG. 1, but those of skill in the art will readily understand how it can be applied to other ride control system embodiments.

At step 302, the pressure in the boom cylinder head side 112 is reduced. This can be done by performing an unpowered lower to ground. Then at step 304, the pressure in the ride control accumulators 104, 106 is brought to a first threshold pressure. This can be done by activating valve HSV1 and stroking the pumps of the hydraulic system 102. This can vary by application and can be determined on a case by case basis. At step 306, the system waits until the ride control accumulator pressure has reached an equilibrium second pressure. This can be done by destroking the pumps of the hydraulic system 102 and closing the valve HSV1. Then at step 308, the elapsed time is recorded to move from the second pressure to a third threshold pressure. Both the second and third pressures can be determined on a case by case basis. This can be done by activating the valve SF4 and recording the elapsed time of the pressure change. Then at step 310, the charge state of the ride control accumulators can be determined from this decay time. This can be done using the most appropriate form of the thermodynamic gas laws.

One exemplary method to determine the charge state of the ride control accumulators is to solve for the decay time produced by the accumulator at the bottom end of its specification, and compare the test result to this value in a pass/fail test. An alternative method is to solve the gas law directly for the precharge pressure given the resulting change in the control volume as quantified by the flow out of the accumulator, which would allow for a "percent life" value to be computed and possibly displayed to the operator.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains.

We claim:

1. A ride control system for a machine having a main hydraulic system, a ride control accumulator, a tank, and a boom cylinder, the boom cylinder having a head side and a rod side, the ride control system comprising:

a first hydraulic system for equalizing pressure between the ride control accumulator and the head side of the boom cylinder;

a second hydraulic system for providing a low pressure drop connection between the ride control accumulator and the head side of the boom cylinder, the second hydraulic system comprising:

a logic valve for controlling fluid flow between the ride control accumulator and the head side of the boom cylinder, the logic valve including an external pilot and an internal pilot;

a first control valve for controlling fluid flow between the ride control system and the external pilot of the logic valve;

a second control valve for controlling fluid flow between the external pilot of the logic valve and the tank;

wherein when the ride control system is engaged, the first hydraulic system equalizes pressure between the ride control accumulator and the head side of the boom cylinder to within a pressure difference threshold, and then the second hydraulic system provides the low pressure drop connection between the ride control accumulator and the head side of the boom cylinder; and wherein activation of the first control valve blocks fluid flow from the ride control system to the external pilot of the logic valve, activation of the second control valve vents the external pilot of the logic valve to the tank, and activation of both the first and second control valves simultaneously vents the external pilot of the logic valve to the tank and enables the logic valve to open and close through the internal pilot.

2. The ride control system of claim 1, further comprising:

a third hydraulic system for providing a hydraulic connection between the rod side of the boom cylinder and the tank;

wherein after the first hydraulic system equalizes pressure between the ride control accumulator and the head side of the boom cylinder to within the pressure difference threshold, then the third hydraulic system provides the hydraulic connection between the rod side of the boom cylinder and the tank.

3. The ride control system of claim 2, further comprising an accumulator pressure sensor for monitoring the pressure of the ride control accumulator, readings from the accumulator pressure sensor being used for equalizing pressure between the ride control accumulator and the head side of the boom cylinder.

4. The ride control system of claim 2, wherein the first hydraulic system comprises:

a ride control valve for controlling fluid flow between the main hydraulic system and the ride control system; and a tank connection control valve for controlling fluid flow between the ride control system and the tank.

5. The ride control system of claim 4, further comprising a check valve preventing fluid flow from the ride control system to the main hydraulic system.

6. The ride control system of claim 4, wherein the first hydraulic system further comprises:

a tank valve in pressure balance between the pressure in the ride control accumulator and the pressure in the head side of the boom cylinder;

wherein when the pressure in the ride control accumulator is greater than the pressure in the head side of the boom cylinder, the tank valve vents pressure from the ride control accumulator to the tank, and when the pressure in the ride control accumulator is less than the pressure in the head side of the boom cylinder, the tank valve prevents the release of pressure from the ride control accumulator to the tank.

7. A method for controlling a ride control system of a machine having a main hydraulic system, a ride control accumulator, a tank, and a boom cylinder, the boom cylinder having a head side and a rod side the method comprising:

waiting until a ride control selector of the machine is enabled and boom controls of the machine are idle;

equalizing pressures of the ride control accumulator and the head side of the boom cylinder;

after equalizing pressures of the ride control accumulator and the head side of the boom cylinder, providing a low pressure drop connection between the ride control accumulator and the head side of the boom cylinder by enabling a logic valve to open through an internal pilot of the logic valve; and disabling ride control when the ride control selector is disabled.

8. The method for controlling the ride control system of claim 7, further comprising:

disabling ride control when the boom controls are activated.

9. The method for controlling the ride control system of claim 7, further comprising:

after equalizing pressures of the ride control accumulator and the head side of the boom cylinder, providing a hydraulic connection between the rod side of the boom cylinder and the tank.

10. The method for controlling the ride control system of claim 9, further comprising:

determining whether automatic ride control mode or manual ride control mode is selected; and disabling ride control when ride control mode is switched from automatic ride control mode to manual ride control mode, or from manual ride control mode to automatic ride control mode.

11. The method for controlling the ride control system of claim 10, further comprising when automatic ride control mode is selected:

after equalizing pressures of the ride control accumulator and the head side of the boom cylinder, determining if machine speed is greater than a speed threshold;

waiting until machine speed is greater than the speed threshold before providing the low pressure drop connection between the ride control accumulator and the head side of the boom cylinder, and before providing the hydraulic connection between the rod side of the boom cylinder and the tank; and disabling ride control when machine speed goes below the speed threshold after machine speed was above the speed threshold.

12. The method for controlling the ride control system of claim 9, wherein equalizing pressures of the ride control accumulator and the head side of the boom cylinder comprises:

determining the pressure difference between the pressure of the ride control accumulator and the pressure of the head side of the boom cylinder;

comparing the determined pressure difference to a threshold pressure difference;

when the determined pressure difference is greater than the threshold pressure difference, adjusting the pressure of the ride control accumulator to make the determined pressure difference less than the threshold pressure difference.

13. The method for controlling the ride control system of claim 12, wherein adjusting the pressure of the ride control accumulator comprises:

when the pressure of the ride control accumulator is less than the pressure of the head side of the boom cylinder, using the main hydraulic system to increase pressure in the ride control accumulator; and when the pressure of the ride control accumulator is greater than the pressure of the head side of the boom cylinder, venting excess fluid from the ride control accumulator to the tank.

14. The method for controlling the ride control system of claim 13, wherein decreasing the pressure of the ride control accumulator further comprises:

using a tank valve to pressure balance between the pressure in the ride control accumulator and the pressure in the head side of the boom cylinder;

wherein when the pressure in the ride control accumulator is greater than the pressure in the head side of the boom cylinder, venting pressure from the ride control accumulator through the tank valve to the tank, and when the pressure in the ride control accumulator is not greater than the pressure in the head side of the boom cylinder, preventing venting of pressure from the ride control accumulator through the tank valve to the tank.

15. The method for controlling the ride control system of claim 7, wherein providing a low pressure drop connection between the ride control accumulator and the head side of the boom cylinder further comprises:

blocking fluid flow between the ride control system and an external pilot of the logic valve; and enabling fluid flow between the external pilot of the logic valve and the tank.

16. The method for controlling the ride control system of claim 7, further comprising:

monitoring the condition of the ride control accumulator.

17. The method for controlling the ride control system of claim 16, wherein monitoring the condition of the ride control accumulator comprises:

increasing the pressure of the ride control accumulator to a high threshold pressure;

discharging the fluid of the ride control accumulator over a known hydraulic restriction;

recording a decay time it takes for the ride control accumulator pressure to go from the high threshold pressure to a low threshold pressure, the low threshold pressure being less than the high threshold pressure; and using the decay time to determine the condition of the ride control accumulator.

18. A method for controlling a ride control system of a machine having a main hydraulic system, a ride control accumulator, a tank, and a boom cylinder, the boom cylinder having a head side and a rod side the method comprising:

waiting until a ride control selector of the machine is enabled and boom controls of the machine are idle;

equalizing pressures of the ride control accumulator and the head side of the boom cylinder;

after equalizing pressures of the ride control accumulator and the head side of the boom cylinder, providing a low pressure drop connection between the ride control accumulator and the head side of the boom cylinder;

monitoring the condition of the ride control accumulator; and disabling ride control when the ride control selector is disabled;

wherein monitoring the condition of the ride control accumulator comprises:

increasing pressure of the ride control accumulator to a high threshold pressure;

discharging the fluid of the ride control accumulator over a known hydraulic restriction;

recording a decay time it takes for the ride control accumulator pressure to go from the high threshold pressure to a low threshold pressure, the low threshold pressure being less than the high threshold pressure; and using the decay time to determine the condition of the ride control accumulator.

19. The method for controlling the ride control system of claim 18, further comprising:

after equalizing pressures of the ride control accumulator and the head side of the boom cylinder, providing a hydraulic connection between the rod side of the boom cylinder and the tank.

20. The method for controlling the ride control system of claim 18, wherein equalizing pressures of the ride control accumulator and the head side of the boom cylinder comprises:

determining a pressure difference between the pressure of the ride control accumulator and the pressure of the head side of the boom cylinder;

comparing the determined pressure difference to a threshold pressure difference;

when the determined pressure difference is greater than the threshold pressure difference, adjusting the pressure of the ride control accumulator to make the determined pressure difference less than the threshold pressure difference.

* * * * *